US009845946B2

(12) United States Patent
Miller

(10) Patent No.: US 9,845,946 B2
(45) Date of Patent: Dec. 19, 2017

(54) WATERPROOF LIGHTING ASSEMBLY

(71) Applicant: Robert Miller, Tamarac, FL (US)

(72) Inventor: Robert Miller, Tamarac, FL (US)

( * ) Notice: Subject to any disclaimer, the term of this patent is extended or adjusted under 35 U.S.C. 154(b) by 127 days.

(21) Appl. No.: 14/871,310

(22) Filed: Sep. 30, 2015

(65) Prior Publication Data

US 2017/0089564 A1 Mar. 30, 2017

(51) Int. Cl.

| | |
|---|---|
| ***F21V 31/00*** | (2006.01) |
| ***F21V 9/08*** | (2006.01) |
| ***F21V 23/02*** | (2006.01) |
| ***F21V 23/04*** | (2006.01) |
| ***F21V 15/01*** | (2006.01) |

(52) U.S. Cl.

CPC ..... *F21V 31/005* (2013.01); *F21V 9/08* (2013.01); *F21V 15/01* (2013.01); *F21V 23/023* (2013.01); *F21V 23/04* (2013.01)

(58) Field of Classification Search

CPC ..... F21V 31/00; F21V 31/005; F21V 21/26; F21V 21/30; F21V 23/023; F21V 23/04; F21V 9/08; F21L 4/04; F21L 4/045

See application file for complete search history.

(56) References Cited

U.S. PATENT DOCUMENTS 5,584,574 A * 12/1996 Haddad ..... F21V 11/00 362/280
5,599,091 A * 2/1997 Kira ..... F21V 21/30 362/269
5,871,272 A * 2/1999 Sharrah ..... F21L 4/025 362/184
5,980,066 A * 11/1999 Belliveau ..... F21S 8/00 362/281
6,357,893 B1 * 3/2002 Belliveau ..... F21L 4/027 257/E25.028
6,966,679 B2 * 11/2005 Matts ..... F16C 11/103 362/267
7,850,330 B2 * 12/2010 Spartano ..... F21L 4/027 362/194
8,100,560 B2 1/2012 Ahland, III et al.
8,246,189 B2 8/2012 Muller et al.
8,360,621 B2 * 1/2013 Avila ..... F21V 21/28 362/147
D705,978 S 5/2014 Rhodes
8,777,446 B2 * 7/2014 Sharrah ..... F21L 4/027 362/197
9,341,324 B2 * 5/2016 Sharrah ..... F21L 4/005
2006/0176686 A1 8/2006 McVicker
2012/0307506 A1 12/2012 Gunn
2013/0301266 A1 11/2013 Poissonnet et al.

* cited by examiner

*Primary Examiner* — Alan Cariaso

(57) ABSTRACT

A waterproof lighting assembly includes a housing that has a top portion that is hingedly coupled to a bottom portion. The top portion is positionable at a selected angle with respect to the bottom portion. A first cap is removably coupled to the bottom portion. A second cap is removably coupled to the first cap. A retainer is removably coupled to the top portion. A plurality of gaskets is provided. Selected ones of the gaskets are positionable between the first cap and the bottom portion, the first cap and the second cap, and the retainer and the top portion. The gaskets form a fluid impermeable seal. A lighting circuit is positioned within the housing such that the lighting circuit may emit light outwardly from the housing.

14 Claims, 5 Drawing Sheets

WATERPROOF LIGHTING ASSEMBLY

BACKGROUND OF THE DISCLOSURE

Field of the Disclosure

The disclosure relates to lighting devices and more particularly pertains to a new lighting device for providing a waterproof source of light.

SUMMARY OF THE DISCLOSURE

An embodiment of the disclosure meets the needs presented above by generally comprising a housing that has a top portion that is hingedly coupled to a bottom portion. The top portion is positionable at a selected angle with respect to the bottom portion. A first cap is removably coupled to the bottom portion. A second cap is removably coupled to the first cap. A retainer is removably coupled to the top portion. A plurality of gaskets is provided. Selected ones of the gaskets are positionable between the first cap and the bottom portion, the first cap and the second cap, and the retainer and the top portion. The gaskets form a fluid impermeable seal. A lighting circuit is positioned within the housing such that the lighting circuit may emit light outwardly from the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
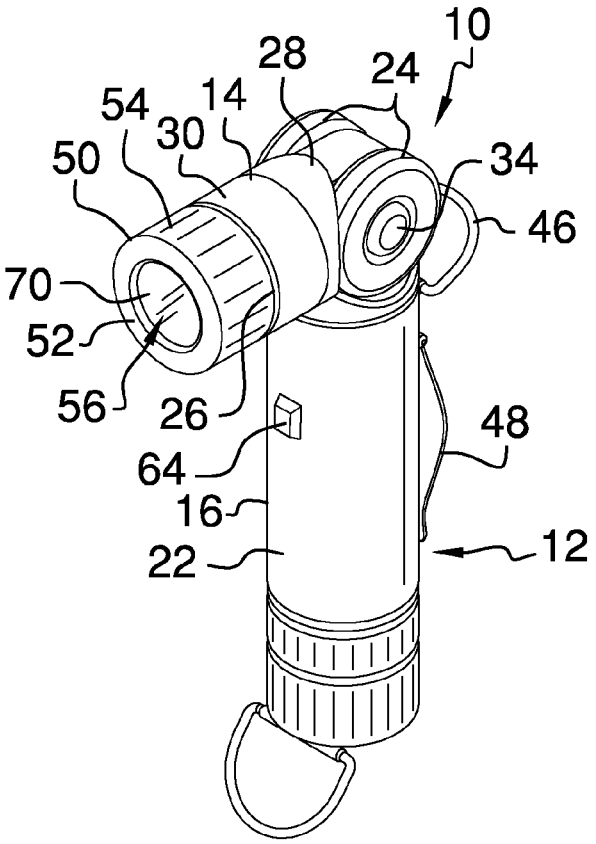
FIG. 1 is a top perspective view of a waterproof lighting assembly according to an embodiment of the disclosure.
Figure 2:
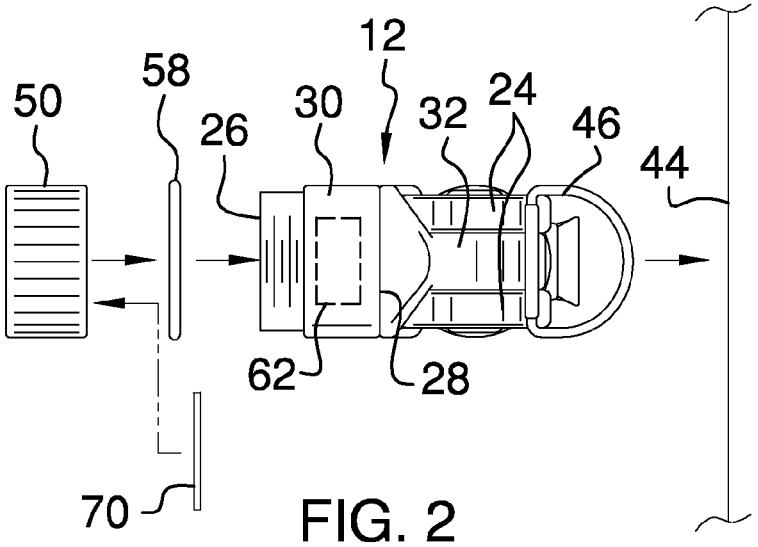
FIG. 2 is a top view of an embodiment of the disclosure.
Figure 3:
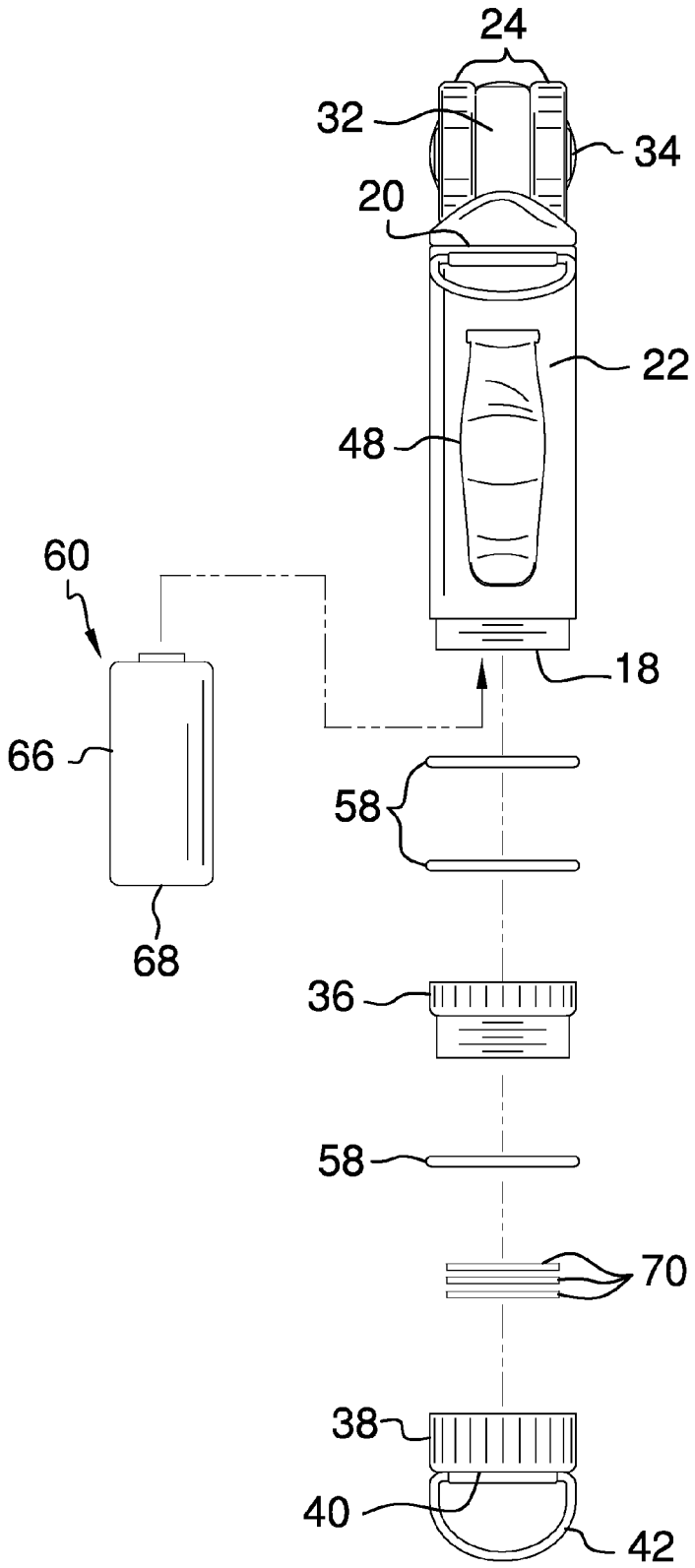
FIG. 3 is an exploded back view of an embodiment of the disclosure.
Figure 4:
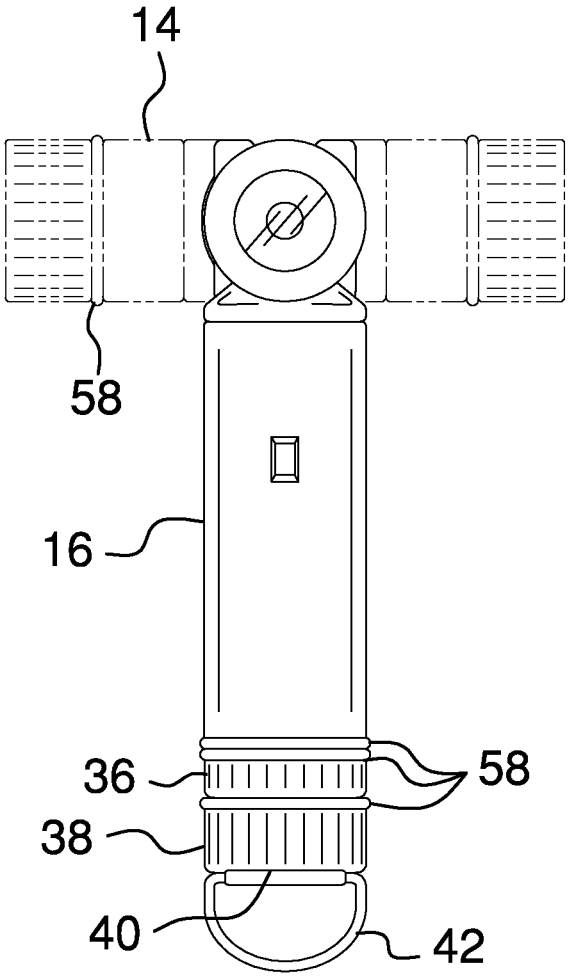
FIG. 4 is a front view of an embodiment of the disclosure.
Figure 5:
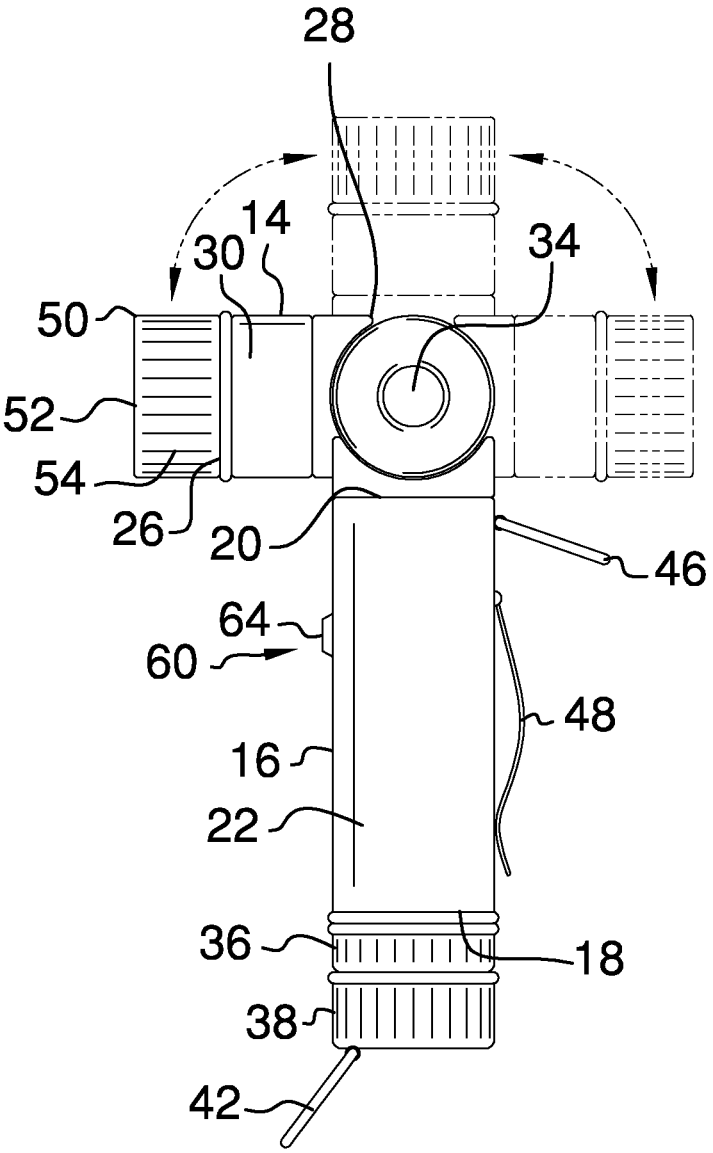
FIG. 5 is a right side view of an embodiment of the disclosure.
Figure 6:
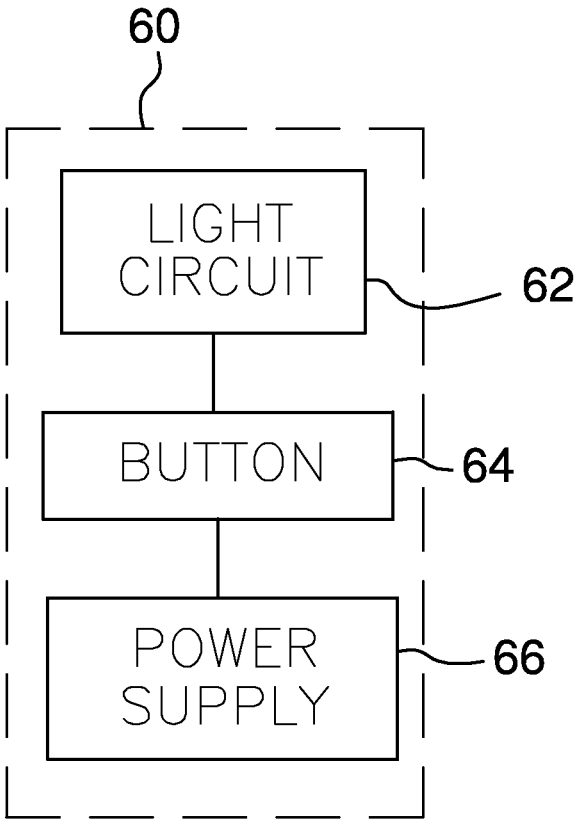
FIG. 6 is a schematic view of an embodiment of the disclosure.

With reference now to the drawings, and in particular to FIGS. 1 through 6 thereof, a new lighting device embodying the principles and concepts of an embodiment of the disclosure and generally designated by the reference numeral 10 will be described.

As best illustrated in FIGS. 1 through 6, the waterproof lighting assembly 10 generally comprises a housing 12 that has a top portion 14 that is hingedly coupled to a bottom portion 16. The top portion 14 is positionable at a selected angle with respect to the bottom portion 16. The bottom portion 16 has a bottom end 18, a top end 20 and an outer wall 22 extending between the bottom end 18 and the top end 20. The bottom end 18 is open and the bottom portion 16 is substantially hollow. The outer wall 22 is curved such that the bottom portion 16 has a cylindrical shape. The top end 20 has a pair of first lobes 24 extending away from the top end 20. The first lobes 24 are spaced apart from each other and the outer wall 22 is threaded adjacent to the bottom end 18.

The top portion 14 has a first end 26, a second end 28 and an exterior wall 30 extending between the first end 26 and the second end 28. The first end 26 is open and the top portion 14 is substantially hollow. The exterior wall 30 is curved such that the top portion 14 has a cylindrical shape. The exterior wall 30 is threaded adjacent to the first end 26 and the second end 28 has a second lobe 32 extending away from the second end 28. The second lobe 32 is positioned between the pair of first lobes 24 such that the top portion 14 is rotatable about an axis extending through the pair of first lobes 24.

A pin 34 is provided and the pin 34 extends through the pair of first lobes 24 and the second lobe 32. Thus, the top portion 14 is rotatably coupled to the bottom portion 16. Each of the first lobes 24 is rotatably coupled to the top end 20 of the bottom portion 16. Each of the first lobes 24 may be rotated about an axis extending through the top end 20 and the bottom end 18. Thus, the top portion 14 may be rotated about the axis extending through the top end 20 and the bottom end 18.

A first cap 36 is removably coupled to the bottom portion 16. The first cap 36 threadably engages the outer wall 22 such that the first cap 36 covers the bottom end 18. A second cap 38 is removably coupled to the first cap 36. The second cap 38 is spaced from the bottom end 18 when the second cap 38 is removably coupled to the first cap 36. The second cap 38 has a basal wall 40. A first ring 42 is coupled to the second cap 38 and the first ring 42 is positioned on the basal wall 40. The first ring 42 may be coupled to a support 44 thereby facilitating the housing 12 to be suspended from the support 44. The support 44 may be an article of clothing or the like.

A second ring 46 is coupled to the bottom portion 16 and the second ring 46 is positioned on the outer wall 22. Thus, the second ring 46 may be coupled to the support 44 thereby facilitating the housing 12 to be suspended from the support 44. The second ring 46 is positioned adjacent to the top end 20. A clip 48 is coupled to the bottom portion 16 and the clip 48 is positioned on the outer wall 22. The clip 48 may engage the support 44 thereby facilitating the housing 12 to be suspended from the support 44.

A retainer 50 is removably coupled to the top portion 14. The retainer 50 has a front wall 52 and a peripheral wall 54 extending away from the front wall 52. The peripheral wall 54 is curved such that the retainer 50 has a cylindrical shape. The front wall 52 has an opening 56 extending therethrough. The peripheral wall 54 threadably engages the exterior wall 30 of the top portion 14 such that the opening 56 is aligned with the first end 26 of the top portion 14.

A plurality of gaskets 58 is provided and each of the gaskets 58 is continuous such that each of the gaskets 58 forms a closed loop. Each of the gaskets 58 is comprised of a resiliently compressible material such as rubber or the like. Selected ones of the gaskets 58 are positionable between the first cap 36 and the bottom portion 16. Thus, the gaskets 58 form a fluid impermeable seal between the first cap 36 and the bottom portion 16.

Selected ones of the gaskets 58 are positionable between the first cap 36 and the second cap 38. Thus, the gaskets 58 form a fluid impermeable seal between the first cap 36 and the second cap 38. Selected ones of the gaskets 58 are positionable between the retainer 50 and the top portion 14. Thus, the gaskets 58 form a fluid impermeable seal between the retainer 50 and the top portion 14.

A lighting circuit 60 is positioned within the housing 12 such that the lighting circuit 60 may emit light outwardly from the housing 12. The lighting circuit 60 comprises a light emitter 62 that is positioned within the top portion 14. The light emitter 62 is positioned proximate the first end 26 such that the light emitter 62 may emit light outwardly from the first end 26. The light emitter 62 may comprise an LED or the like.

A button 64 is coupled to the bottom portion 16. The button 64 is positioned on the outer wall 22 such that the button 64 may be manipulated. The button 64 is electrically coupled to the light emitter 62 such that the button 64 turns the light emitter 62 on and off. The button 64 is hermetically sealed with respect to the outer wall 22.

A power supply 66 is positioned within the bottom portion 16. The power supply 66 is electrically coupled to the button 64 when the power supply 66 is positioned within the bottom portion 16. The power supply 66 comprises at least one battery 68. A plurality of lenses 70 is provided and each of the lenses 70 is stored within the second cap 38. A selected one of the lenses 70 is positioned within the retainer 50 such that the selected lens 70 covers the opening 56 in the retainer 50. The selected lens 70 is positioned between the opening 56 and the light emitter 62.

Each of the lenses 70 is comprised of an translucent material. Thus, each of the lenses 70 allows light from the light emitter 62 to pass through the lenses 70. Each of the lenses 70 has a distinct color with respect to each other. Thus, each of the lenses 70 may impart a selected color to the light emitted from the light emitter 62. The lenses 70 may have a blue color, a yellow color and a red color.

In use, the top portion 14 is manipulated such that the top portion 14 is positioned at the selected angle with respect to the bottom portion 16. Additionally, the top portion 14 may be rotated about the axis extending through the top end 20 and the bottom end 18. Thus, the light emitter 62 emits light at a variety of angles with respect to the bottom portion 16. A selected one of the lenses 70 is positioned within the retainer 50 to impart the selected color to the light emitted by the light emitter 62. The button 64 is manipulated to turn the light emitter 62 on and off thereby facilitating the light emitter 62 to illuminate a desired area.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A waterproof lighting assembly comprising:

a housing having a top portion being hingedly coupled to a bottom portion such that said top portion is positionable at a selected angle with respect to said bottom portion, said bottom portion having an outer wall and a bottom end;

a first cap being removably coupled to said bottom portion, said first cap threadably engaging said outer wall such that said first cap covers said bottom end;

a second cap being removably coupled to said first cap, said second cap being spaced from said bottom end when said second cap is removably coupled to said first cap, said second cap having a basal wall;

a retainer being removably coupled to said top portion;

a plurality of gaskets, each of said gaskets being continuous such that each of said gaskets forms a closed loop, selected ones of said gaskets being positionable between said first cap and said bottom portion wherein said gaskets are configured to form a fluid impermeable seal between said first cap and said bottom portion, selected ones of said gaskets being positionable between said first cap and said second cap wherein said gaskets are configured to form a fluid impermeable seal between said first cap and said second cap, selected ones of said gaskets being positionable between said retainer and said top portion wherein said gaskets are configured to form a fluid impermeable seal between said retainer and said top portion; and a lighting circuit being positioned within said housing wherein said lighting circuit is configured to emit light outwardly from said housing.

2. The assembly according to claim 1, wherein said bottom portion has a bottom end, a top end and an outer wall extending between said bottom end and said top end, said bottom end being open, said bottom portion being substantially hollow, said outer wall being curved such that said bottom portion has a cylindrical shape, said top end having a pair of first lobes extending away from said top end, said first lobes being spaced apart from each other, said outer wall being threaded adjacent to said bottom end.

3. The assembly according to claim 2, wherein said top portion has a first end, a second end and an exterior wall extending between said first end and said second end, said first end being open, said top portion being substantially hollow, said exterior wall being curved such that said top portion has a cylindrical shape, said exterior wall being threaded adjacent to said first end, said second end having a second lobe extending away from said second end, said second lobe being positioned between said pair of first lobes such that said top portion is rotatable about an axis extending through said pair of first lobes.

4. The assembly according to claim 3, further comprising a pin extending through said pair of first lobes and said second lobe such that said top portion is rotatably coupled to said bottom portion.

5. The assembly according to claim 1, further comprising a first ring being coupled to said second cap, said first ring being positioned on said basal wall wherein said first ring is configured to be coupled to a support thereby facilitating said housing to be suspended from the support.

6. The assembly according to claim 5, further comprising a second ring being coupled to said bottom portion, said second ring being positioned on said outer wall wherein said second ring is configured to be coupled to the support thereby facilitating said housing to be suspended from the support, said second ring being positioned adjacent to said top end.

7. The assembly according to claim 5, further comprising a clip being coupled to said bottom portion, said clip being positioned on said outer wall wherein said clip is configured to engage the support thereby facilitating said housing to be suspended from the support.

8. The assembly according to claim 3, wherein said retainer has a front wall and a peripheral wall extending away from said front wall, said peripheral wall being curved such that said retainer has a cylindrical shape, said front wall having an opening extending therethrough, said peripheral wall threadably engaging said exterior wall of said top portion such that said opening is aligned with said first end of said top portion.

9. The assembly according to claim 3, wherein said lighting circuit comprises a light emitter being positioned within said top portion, said light emitter being positioned proximate said first end wherein said light emitter is configured to emit light outwardly from said first end.

10. The assembly according to claim 9, wherein said lighting circuit further comprises a button being coupled to said bottom portion, said button being positioned on said outer wall wherein said button is configured to be manipulated, said button being electrically coupled to said light emitter such that said button turns said light emitter on and off, said button being hermetically sealed with respect to said outer wall.

11. The assembly according to claim 10, wherein said lighting circuit further comprises a power supply being positioned within said bottom portion, said power supply being electrically coupled to said button when said power supply is positioned within said bottom portion, said power supply comprising at least one battery.

12. A waterproof lighting assembly comprising:

a housing having a top portion being hingedly coupled to a bottom portion such that said top portion is positionable at a selected angle with respect to said bottom portion;

a first cap being removably coupled to said bottom portion;

a second cap being removably coupled to said first cap;

a retainer being removably coupled to said top portion;

a plurality of gaskets, each of said gaskets being continuous such that each of said gaskets forms a closed loop, selected ones of said gaskets being positionable between said first cap and said bottom portion wherein said gaskets are configured to form a fluid impermeable seal between said first cap and said bottom portion, selected ones of said gaskets being positionable between said first cap and said second cap wherein said gaskets are configured to form a fluid impermeable seal between said first cap and said second cap, selected ones of said gaskets being positionable between said retainer and said top portion wherein said gaskets are configured to form a fluid impermeable seal between said retainer and said top portion; and a lighting circuit being positioned within said housing wherein said lighting circuit is configured to emit light outwardly from said housing;

said retainer having an opening;

said lighting circuit includes a light emitter; and a plurality of lenses, each of said lenses being stored within said second cap, a selected one of said lenses being positioned within said retainer such that said selected lens covers said opening in said retainer having said selected lens being positioned between said opening and said light emitter.

13. The assembly according to claim 12, wherein each of said lenses is comprised of an translucent material such that each of said lenses is configured to allow light from said light emitter to pass through said lenses, each of said lenses having a distinct color with respect to each other wherein each of said lenses is configured to impart a selected color to the light emitted from said light emitter.

14. A waterproof lighting assembly comprising:

a housing having a top portion being hingedly coupled to a bottom portion such that said top portion is positionable at a selected angle with respect to said bottom portion, said bottom portion having a bottom end, a top end and an outer wall extending between said bottom end and said top end, said bottom end being open, said bottom portion being substantially hollow, said outer wall being curved such that said bottom portion has a cylindrical shape, said top end having a pair of first lobes extending away from said top end, said first lobes being spaced apart from each other, said outer wall being threaded adjacent to said bottom end, said top portion having a first end, a second end and an exterior wall extending between said first end and said second end, said first end being open, said top portion being substantially hollow, said exterior wall being curved such that said top portion has a cylindrical shape, said exterior wall being threaded adjacent to said first end, said second end having a second lobe extending away from said second end, said second lobe being positioned between said pair of first lobes such that said top portion is rotatable about an axis extending through said pair of first lobes;

a pin extending through said pair of first lobes and said second lobe such that said top portion is rotatably coupled to said bottom portion;

a first cap being removably coupled to said bottom portion, said first cap threadably engaging said outer wall such that said first cap covers said bottom end;

a second cap being removably coupled to said first cap, said second cap being spaced from said bottom end when said second cap is removably coupled to said first cap, said second cap having a basal wall;

a first ring being coupled to said second cap, said first ring being positioned on said basal wall wherein said first ring is configured to be coupled to a support thereby facilitating said housing to be suspended from the support;

a second ring being coupled to said bottom portion, said second ring being positioned on said outer wall wherein said second ring is configured to be coupled to the support thereby facilitating said housing to be suspended from the support, said second ring being positioned adjacent to said top end;

a clip being coupled to said bottom portion, said clip being positioned on said outer wall wherein said clip is configured to engage the support thereby facilitating said housing to be suspended from the support;

a retainer being removably coupled to said top portion, said retainer having a front wall and a peripheral wall extending away from said front wall, said peripheral wall being curved such that said retainer has a cylindrical shape, said front wall having an opening extending therethrough, said peripheral wall threadably engaging said exterior wall of said top portion such that said opening is aligned with said first end of said top portion;

a plurality of gaskets, each of said gaskets being continuous such that each of said gaskets forms a closed loop, selected ones of said gaskets being positionable between said first cap and said bottom portion wherein said gaskets are configured to form a fluid impermeable seal between said first cap and said bottom portion, selected ones of said gaskets being positionable between said first cap and said second cap wherein said gaskets are configured to form a fluid impermeable seal between said first cap and said second cap, selected ones of said gaskets being positionable between said retainer and said top portion wherein said gaskets are configured to form a fluid impermeable seal between said retainer and said top portion;

a lighting circuit being positioned within said housing wherein said lighting circuit is configured to emit light outwardly from said housing, said lighting circuit comprising:

a light emitter being positioned within said top portion, said light emitter being positioned proximate said first end wherein said light emitter is configured to emit light outwardly from said first end, a button being coupled to said bottom portion, said button being positioned on said outer wall wherein said button is configured to be manipulated, said button being electrically coupled to said light emitter such that said button turns said light emitter on and off, said button being hermetically sealed with respect to said outer wall, and a power supply being positioned within said bottom portion, said power supply being electrically coupled to said button when said power supply is positioned within said bottom portion, said power supply comprising at least one battery; and a plurality of lenses, each of said lenses being stored within said second cap, a selected one of said lenses being positioned within said retainer such that said selected lens covers said opening in said retainer having said selected lens being positioned between said opening and said light emitter, each of said lenses being comprised of an translucent material such that each of said lenses is configured to allow light from said light emitter to pass through said lenses, each of said lenses having a distinct color with respect to each other wherein each of said lenses is configured to impart a selected color to the light emitted from said light emitter.

* * * * *